US010301827B2

(12) United States Patent
Yamazaki et al.

(10) Patent No.: US 10,301,827 B2
(45) Date of Patent: May 28, 2019

(54) METHOD OF FORMATION OF COMPRESSION-BONDED STRUCTURE

(71) Applicant: FUJI BOLT Manufacturing Co., Ltd., Tokyo (JP)

(72) Inventors: Fujio Yamazaki, Tokyo (JP); Norio Matsubara, Tokyo (JP); Ryo Shimizu, Tokyo (JP)

(73) Assignee: Fujio Bolt Manufacturing Co. Ltd., Tokyo (JP)

( * ) Notice: Subject to any disclaimer, the term of this patent is extended or adjusted under 35 U.S.C. 154(b) by 856 days.

(21) Appl. No.: 14/366,055

(22) PCT Filed: Dec. 21, 2012

(86) PCT No.: PCT/JP2012/083334
§ 371 (c)(1),
(2) Date: Jun. 17, 2014

(87) PCT Pub. No.: WO2013/094750
PCT Pub. Date: Jun. 27, 2013

(65) Prior Publication Data

US 2014/0318704 A1 Oct. 30, 2014

(30) Foreign Application Priority Data

Dec. 21, 2011 (JP) ..... 2011-280191
Sep. 4, 2012 (JP) ..... 2012-194186

(51) Int. Cl.
*E04C 5/18* (2006.01)
*E04C 5/16* (2006.01)

(52) U.S. Cl.
CPC ..... *E04C 5/18* (2013.01); *E04C 5/165* (2013.01)

(58) Field of Classification Search
None
See application file for complete search history.

(56) References Cited

U.S. PATENT DOCUMENTS 4,241,490 A 12/1980 Edwards
5,643,994 A * 7/1997 Kish ..... C04B 26/06 52/698

(Continued)

FOREIGN PATENT DOCUMENTS

GB 2034857 A * 6/1980 ..... E04C 5/165
JP 53-4318 A 1/1978

(Continued)

OTHER PUBLICATIONS

International Search Report for PCT Patent App. No. PCT/JP2012/083334 (dated Mar. 4, 2013).

*Primary Examiner* — Jeffry H Aftergut
*Assistant Examiner* — Jaeyun Lee
(74) *Attorney, Agent, or Firm* — Law Office of Chris Mizumoto

(57) ABSTRACT

In a bonding structure for bonding a bonding attachment, having an insertion hole formed to allow insertion of a rebar therein, to the rebar, an application liquid mixed with a granular fine powder is previously applied on the rebar or the inside of the insertion hole of the bonding attachment, and then the bonding attachment is bonded to the rebar inserted in the insertion hole. Thereby, the granular fine powder is disposed on the contact surfaces of the bonding attachment and the rebar inserted in the insertion hole of the bonding attachment, increasing the friction force to resist against the force to pull the inserted rebar out from the insertion hole.

2 Claims, 14 Drawing Sheets

(56) References Cited

U.S. PATENT DOCUMENTS

| | | | |
|---|---|---|---|
| 2006/0196146 | A1 | 9/2006 | Schwegler |
| 2009/0044483 | A1 | 2/2009 | Schwegler |

FOREIGN PATENT DOCUMENTS

| | | | | |
|---|---|---|---|---|
| JP | 53-124542 | A | | 10/1978 |
| JP | 58-162680 | A | | 9/1983 |
| JP | 61057745 | A | * | 3/1986 |
| JP | 62292365 | A | * | 12/1987 |
| JP | 10-131303 | A | | 5/1998 |
| JP | 2004-183325 | A | | 7/2004 |
| JP | 2005-066574 | A | | 3/2005 |
| JP | 2009-108675 | A | | 5/2009 |
| KR | 20030094607 | A | * | 12/2003 |

* cited by examiner

METHOD OF FORMATION OF COMPRESSION-BONDED STRUCTURE

This application is a national phase entry under 35 U.S.C. § 371 of PCT Patent Application No. PCT/JP2012/083334, filed on Dec. 21, 2012, which claims priority under 35 U.S.C. § 119 to Japanese Patent Application No. 2011-280191, filed Dec. 21, 2011, and Japanese Patent Application No. 2012-194186, filed Sep. 4, 2012, all of which are incorporated by reference.

TECHNICAL FIELD

The present invention relates to a bonding structure of a rebar and a bonding attachment and a method of bonding a rebar and a bonding attachment, particularly, to an art to enhance the bonding strength of the rebar and the bonding attachment by bonding the rebar and the bonding attachment with a granular fine powder disposed on contact surfaces of the rebar and the bonding attachment.

BACKGROUND ART

Conventionally, a mechanical joint for connecting a pair of rebars by inserting one of end portions of a rebar and one of end portions of another rebar in a sleeve is provided.

For example, a mechanical joint is provided in Patent Literature 1, in which one of end portions of a rebar and one of end portions of another rebar are inserted in a sleeve so as to abut against each other, and then the sleeve is pressed from the outer peripheral surface to bond the sleeve to the rebar.

In such mechanical joint, predetermined tensile strength has to be secured to hold the tensile force acting on the rebar. Such tensile strength is secured by a structure having a knot provided on the peripheral surface of the rebar or a structure providing interlocking of the knot with the inner peripheral surface of the sleeve.

As for the issue of securing the pull-out strength of the rebar, Patent Literature 2 proposes a rebar providing improved bonding strength to concrete. Epoxy powder coating is sprayed on a heated rebar to form a first anticorrosion film, and on the surface of the molten first anticorrosion film, a second anticorrosion film is formed with a powder coating which is a mixture of epoxy resin and curing agent. Innumerable number of protrusion formed by the second anticorrosion film enhances the bonding strength to concrete.

Patent Literature 3 proposes a method of attaching a metal sleeve to a concrete-reinforcing bar. In the method, a particle having higher hardness than both the concrete-reinforcing bar and the sleeve is disposed between the opposing surfaces of the sleeve and the bar. By the particle interlocking with the bar and the sleeve, the sleeve is bonded to the bar with sufficient force to hold the bar and the sleeve together.

CITATION LIST

Patent Literatures

Patent Literature 1: JP 10-131303 A
Patent Literature 2: JP 2005-66574 A
Patent Literature 3: JP 53-4318 A

SUMMARY OF INVENTION

Technical Problem

Structures provided in Patent Literatures 1 and 2 enhance the tensile strength of connected bars and the pull-out strength of the rebar bonded to concrete. However, these structures are not focused on contact surfaces of the bar and the metal attachment bonded to the bar, so that these structures are not aimed to enhance the friction force between the bar and the metal attachment to secure the bonding strength of the bar and the metal attachment.

Specifically, in the method described in Patent Literature 3, a particle including a chilled steel ball or the like having a dimension of 0.8 to 1.5 mm, or a mesh size of around 16 meshes, is disposed between the sleeve and the bar, and the particle is adhered to the sleeve and the bar with an adhesive including a curing agent, such as a plastic adhesive based on epoxy resin and curing agent or a neoprene based adhesive.

In this method, the particle with such grain size and the adhesive are used to interlock the particle with the sleeve and the bar so as to enhance the bonding strength of the sleeve and the bar. However, since the viscosity of such adhesive is high, the particle is likely to sink in the adhesive, and the adhesive will harden before inserting the bar in the sleeve, making the insertion difficult. If the particle sinks in the adhesive, the particle cannot contribute to improvement of bonding strength of the sleeve and the bar. Moreover, the hardened adhesive itself reduces the friction between the sleeve and the bar, resulting in reduction of the bonding strength.

With regard to the method of forming a bonding structure of a rebar and a bonding attachment bonded to the rebar, the object of the present invention is to enhance the bonding strength of the rebar and the bonding attachment by increasing the friction force on the contact surfaces of the rebar and the bonding attachment.

Solution to Problem

According to an aspect of the present invention, to achieve the object mentioned above, a method of forming a bonding structure in which a bonding attachment having an insertion hole for inserting the rebar is bonded to a rebar includes a step of spraying an application liquid including a water-soluble resin emulsion mixed with a granular fine powder with a grain size of 180 to 600 μm on the outer peripheral surface of the rebar and/or the inner peripheral surface of an insertion hole of the bonding attachment, a step of inserting the rebar in the insertion hole of the bonding attachment, and a step of bonding the bonding attachment to the rebar by pressing the bonding attachment in which the rebar is inserted in the insertion hole.

The bonding attachment is a metal attachment to be bonded to the rebar such as a sleeve which functions as a mechanical joint connecting rebars and a metal attachment attached to the rebar to enhance the fixing force on concrete.

The grain size of the granular fine powder may be from 180 to 300 μm.

The granular fine powder may be silicon carbide based material or aluminum based material.

Advantageous Effects of Invention

According to the present invention, a granular fine powder is applied to contact surfaces of a rebar and a bonding attachment when the bonding structure of the rebar and the bonding attachment is to be formed. The bonding structure thus formed can enhance the bonding strength of the rebar and the bonding attachment by the granular fine powder disposed on the contact surfaces of the rebar and the bonding attachment increasing the friction force between the rebar and the bonding attachment.

DESCRIPTION OF EMBODIMENTS

Figure 1:
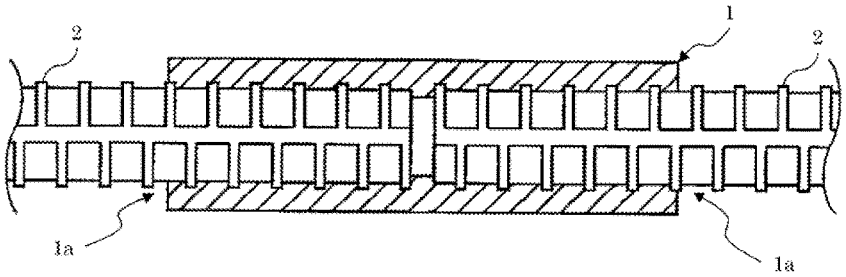
FIG. 1 is a partial cross sectional view illustrating a bonding structure formed by a method of forming a bonding structure according to an embodiment of the present invention.

The method of forming a bonding structure of a rebar and a bonding attachment according to the present invention will be described referring to the drawings.

The bonding structure formed by the embodiment is configured as a mechanical joint including a rebar and a sleeve which is a bonding attachment bonded to the rebar.

As illustrated in FIG. 1, in the bonding structure formed by the method of forming a bonding structure of a rebar and a bonding attachment according to the embodiment, a rebar 2 is inserted in each of both ends of an insertion hole 1*a* formed in a sleeve 1. The sleeve 1 is bonded to the rebar 2 to connect a pair of rebars.

The sleeve 1 has an approximately cylindrical shape with the insertion hole 1*a* formed to have openings on both ends. The diameter of the insertion hole 1*a* is slightly larger than the diameter of the rebar 2 so that the rebar 2 can be inserted in the insertion hole 1*a*.

Figure 2:
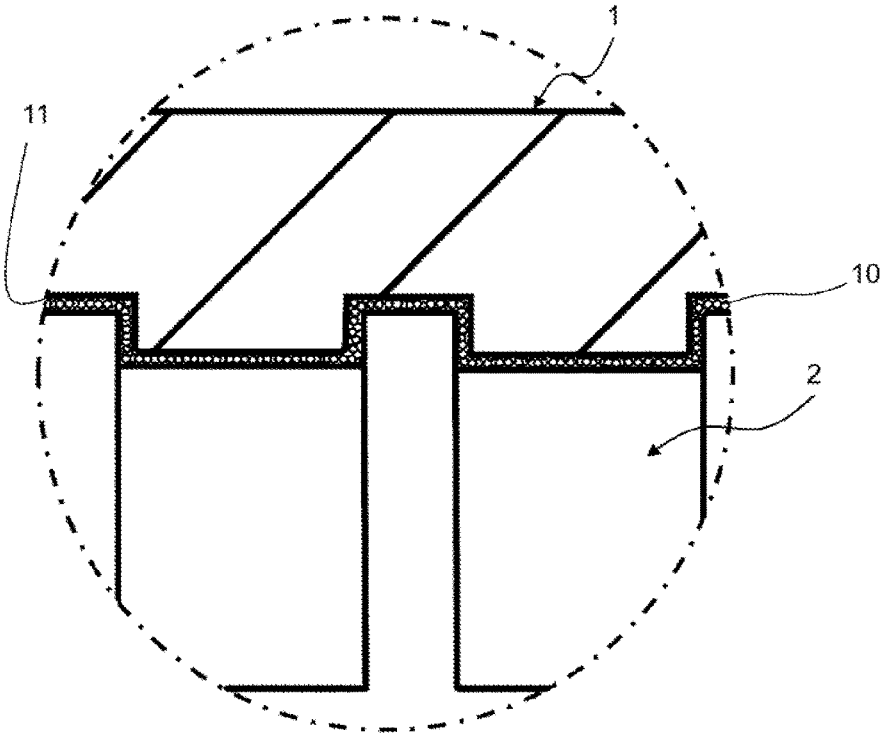
FIG. 2 is a partially enlarged view illustrating a bonding structure of a rebar and a bonding attachment formed by the method of forming a bonding structure according to the embodiment.

Further, as illustrated in FIG. 2, on contact surfaces of the inner peripheral surface of the insertion hole 1*a* and the outer peripheral surface of the rebar 2, which make contact with each other, a granular fine powder 10 is disposed to increase the friction force on the contact surfaces. In the embodiment, the granular fine powder 10 is adhered to the inner peripheral surface of the insertion hole 1*a* and the outer peripheral surface of the rebar 2 with application liquid.

The granular fine powder 10 is an inorganic granule based fine powder such as a silicon carbide based fine powder or an aluminum based fine powder with a grain size from 180 to 600 μm. The granular fine powder 10 may includes a fine powder with a certain grain size from 180 to 600 μm, for example, a grain size of 300 μm, or a mixture of fine powders with grain sizes ranging from 180 to 600 μm, for example, from 200 to 400 μm.

The type of the rebar 2 connected in the embodiment is not particularly limited; however, the embodiment illustrates, in the drawings, a deformed bar in which knots are formed on the outer peripheral surface, parallel to each other, with a constant pitch.

Figure 3:
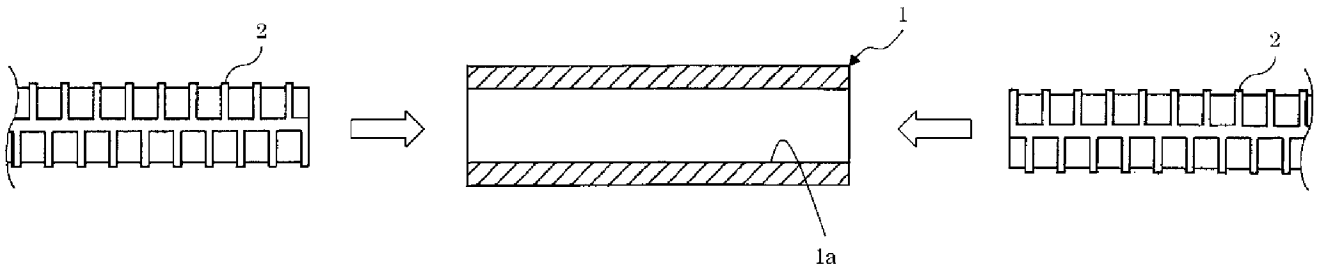
FIG. 3 illustrates a process of connecting rebars by the method of forming a bonding structure according to the embodiment.
Figure 4:
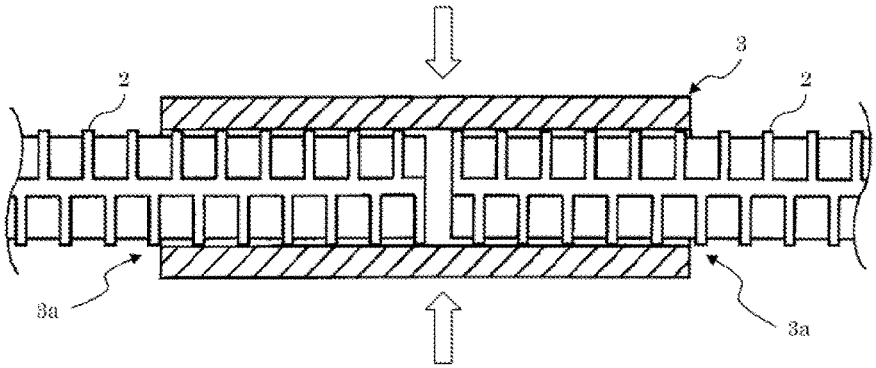
FIG. 4 illustrates a process of connecting rebars by the method of forming a bonding structure according to the embodiment.

Now, the method of bonding the sleeve 1 to the rebar 2 is described referring to FIGS. 3 and 4.

As illustrated in FIG. 3, an application liquid which is a mixture of a predetermined liquid and the granular fine powder 10 is previously applied to the inner peripheral surface of the insertion hole 1*a* or the outer peripheral surface of the rebar 2, and the rebar 2 is inserted in the insertion hole 1*a* of the sleeve 1 from each of both ends of the insertion hole 1*a*. The application liquid which is a mixture of the predetermined liquid and the granular fine powder 10 may be applied to both of the inner peripheral surface of the insertion hole 1*a* and the outer peripheral surface of the rebar 2.

The liquid for mixing the granular fine powder 10 therein has a predetermined viscosity providing adhesion to the surface when applied. Specifically, the liquid is a synthetic resin emulsion of a water-soluble resin using water as a dispersion medium. As a water-soluble resin, a natural water-soluble resin such as Arabian gum and dextrin, a semi-synthetic water-soluble resin such as carboxyl methylcellulose, hydroxyethyl cellulose, and hydroxypropyl cellulose, and a synthetic water-soluble resin such as polyvinyl alcohol and acrylic resin can be used.

As illustrated in FIG. 4, under the state in which the granular fine powder 10 is adhered to the inner peripheral surface of the insertion hole 1*a* or the outer peripheral surface of the rebar 2 with the application liquid, the rebar 2 is inserted in the insertion hole 1*a* and then the sleeve 1 is pressed radially inward from the outer peripheral surface of the sleeve 1. By the pressing, the insertion hole 1*a* shrinks to reduce the diameter and the inner peripheral surface of the insertion hole 1*a* and the rebar 2 are bonded with the granular fine powder 10 disposed in between.

When bonding is completed, the application liquid evaporates with the help of the heat produced during bonding but the granular fine powder 10 remains, and thereby only the granular fine powder 10 is disposed between the inner peripheral surface of the insertion hole 1*a* and the rebar 2.

By the process described above, the rebar and the sleeve 1 are bonded with the granular fine powder 10 disposed between the contact surfaces. As a result, the granular fine powder 10 increases the friction force between the rebar 2 and the sleeve 1, thereby enhancing the bonding strength of the rebar 2 and the sleeve 1. Particularly, since the high friction force can be provided to the smooth surface without ribs formed on the rebar 2, shorter sleeves can provide the same degree of strength as longer sleeves. The embodiment is particularly advantageous in the application where shorter sleeves are preferable.

Further, plastic working of the sleeve 1 performed to reduce the inner diameter of the insertion hole 1*a* provides high strength.

Figure 5:
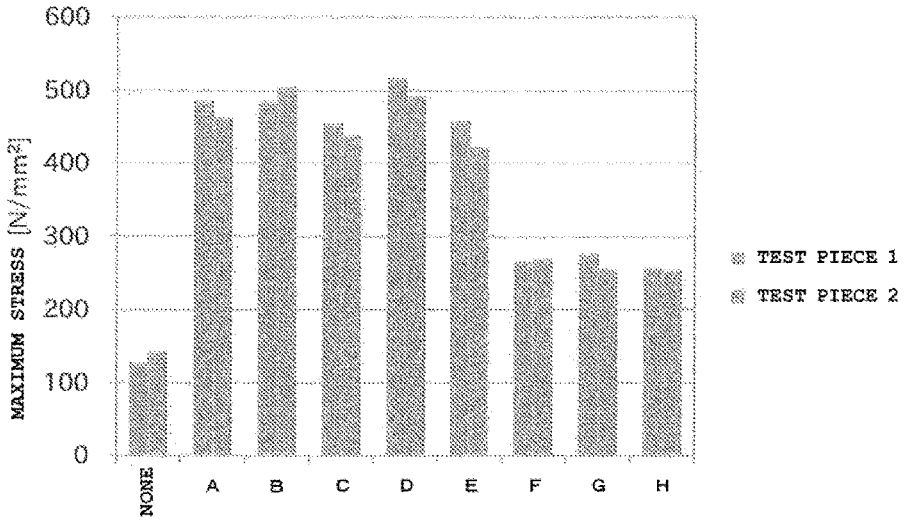
FIG. 5 is a chart illustrating the result of the evaluation test performed for the bonding structure of a rebar and a bonding attachment formed by the method of forming a bonding structure according to the embodiment.
Figure 6:
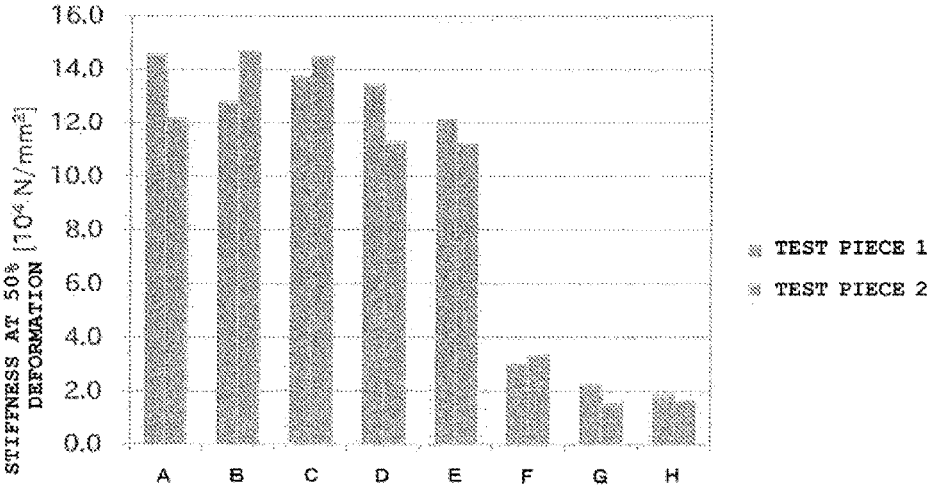
FIG. 6 is a chart illustrating the result of the evaluation test performed for the bonding structure of a rebar and a bonding attachment formed by the method of forming a bonding structure according to the embodiment.
Figure 7:
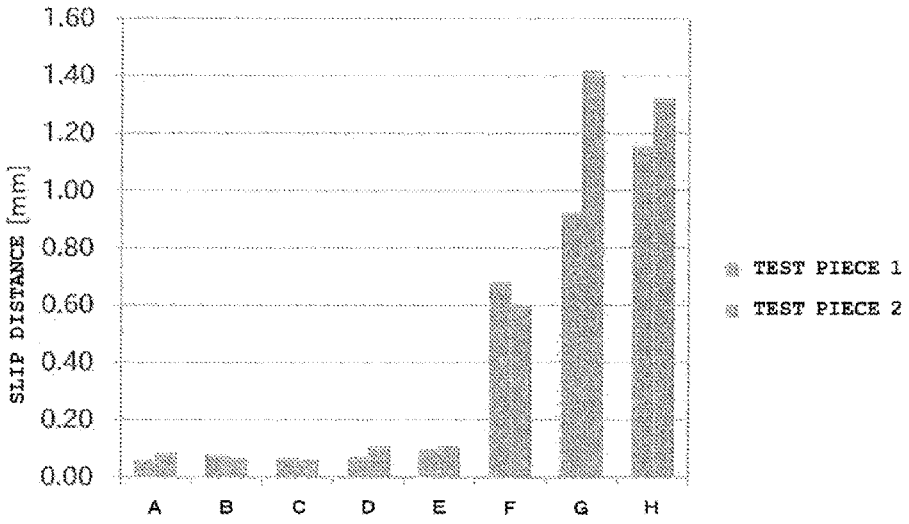
FIG. 7 is a chart illustrating the result of the evaluation test performed for the bonding structure of a rebar and a bonding attachment formed by the method of forming a bonding structure according to the embodiment.

The performance is evaluated for the bonding structure formed as described above, with different grain sizes of the granular fine powder 10. Test results are listed in Table 1 and FIGS. 5 to 7.

Note that, the stiffness and the slip distance are not measured for the test piece without the granular fine powder 10, since the pull-out occurred in the test piece under the stress of, or below, 172.5 N/mm$^2$ which is 50% of the standard yield strength.

TABLE 1

| Test piece | | Tested length [mm] | Maximum stress [N/mm$^2$] | Secant stiffness at 50% deformation [$10^4$N/mm$^2$] | Slip distance [mm] |
|---|---|---|---|---|---|
| None | 1 | 130 | 128 | — | — |
| | 2 | 130 | 143 | — | — |
| A (Grain size: | 1 | 130 | 485 | 14.6 | 0.06 |
| 1180μ | 2 | 130 | 461 | 12.2 | 0.08 |
| B (Grain size: | 1 | 130 | 485 | 12.8 | 0.08 |
| 600μ | 2 | 130 | 504 | 14.7 | 0.06 |
| C (Grain size: | 1 | 130 | 453 | 13.7 | 0.07 |
| 425μ | 2 | 130 | 437 | 14.5 | 0.06 |
| D (Grain size: | 1 | 130 | 516 | 13.4 | 0.07 |
| 300μ | 2 | 130 | 491 | 11.3 | 0.10 |
| E (Grain size: | 1 | 130 | 457 | 12.1 | 0.09 |
| 180μ | 2 | 130 | 421 | 11.2 | 0.11 |
| F (Grain size: | 1 | 130 | 264 | 3 | 0.68 |
| 75 μm) | 2 | 130 | 269 | 3.3 | 0.59 |
| G (Grain size: | 1 | 130 | 276 | 2.3 | 0.92 |
| 27 μm) | 2 | 130 | 255 | 1.5 | 1.41 |
| H (Grain size: | 1 | 130 | 256 | 1.8 | 1.15 |
| 13 μm) | 2 | 130 | 254 | 1.6 | 1.32 |

According to the test result, test piece D shows the highest strength, test piece B shows the second highest strength, and test piece A shows the third highest strength. Further, test piece C shows the highest stiffness, test piece B shows the second highest stiffness, test piece A shows the third highest stiffness, and test piece D shows the fourth highest stiffness. Test pieces F to H of which grain size is 75 μm or smaller show significantly lower strength than test pieces A to E.

From the test result, it is discovered that the granular fine powder 10 with a grain size within the range from 180 to 1180 μm is preferably used.

However, in the process before bonding the sleeve 1 and the rebar 2, when the granular fine powder 10 with relatively large grain size within the range mentioned above is used, it is difficult to adhere the granular fine powder 10 to the outer peripheral surface of the rebar 2 or the inner peripheral surface of the sleeve 1 with the application liquid, and the adhered granular fine powder 10 may easily come off. Regarding this problem, by using an application liquid having higher viscosity or stronger adhesion, the granular fine powder 10 can be kept adhered in place without coming off. However, when such application liquid is used, the rebar 2 sticks to the insertion hole 1*a* of the sleeve 1 upon inserting the rebar 2 in the sleeve 1, making the insertion difficult, and also the granular fine powder 10 sinks in the application liquid and does not contribute to the increase in the friction force between the rebar 2 and the sleeve 1.

Therefore, it has been studied that, to keep the granular fine powder 10 adhered to the rebar 2 or the sleeve 1 using the application liquid with moderate viscosity and adhesion as well as to provide sufficient strength to the bonding structure, the grain size of the granular fine powder 10 is preferably within the range from 180 to 600 μm, more preferably, from 180 to 300 μm.

Now, the method of forming a bonding structure of a rebar and a bonding attachment according to another embodiment of the present invention will be described.

Figure 8:
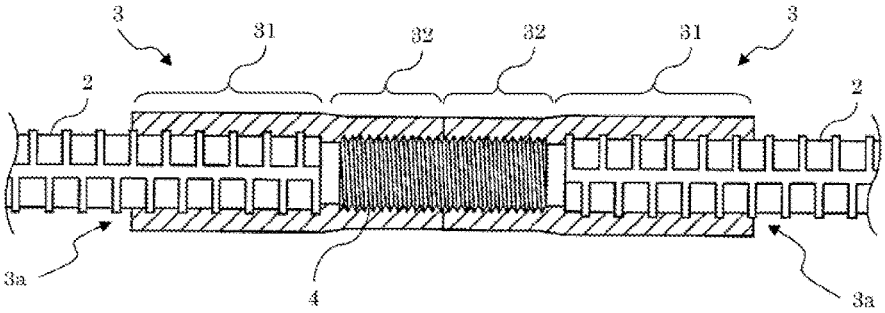
FIG. 8 is a partial cross sectional view illustrating another bonding structure of a rebar and a bonding attachment formed by the method of forming a bonding structure according to the embodiment.

As illustrated in FIG. 8, the bonding structure formed by the embodiment is configured as a mechanical joint. The end portion of the rebar 2 is inserted in one end of each of a pair of sleeves 3. The other end of each of the pair of sleeves 3 is connected by a connector 4 and the granular fine powder is disposed between the sleeve 3 and the rebar 2 to bond the sleeve 3 and the rebar 2 to constitute the bonding structure.

Similarly to the sleeve 1, the sleeve 3 has an approximately cylindrical shape with the insertion hole 3*a* formed to have openings on both ends.

The sleeve 3 differs from the sleeve 1 in that one end of the sleeve 3 constitutes an insertion part 31 for inserting the rebar 2 therein, and the other end constitutes a threaded portion 32 for attaching the connector 4 thereto.

The diameter of the insertion hole 3*a* of the insertion part 31 is slightly larger than the diameter of the rebar 2 to allow insertion of the rebar 2.

On contact surfaces of the inner peripheral surface of the insertion hole 3*a* of the insertion part 31 and the outer peripheral surface of the rebar 2, which make contact with each other, the granular fine powder is disposed to increase the friction force on the contact surfaces. In the embodiment, the granular fine powder is adhered to the inner peripheral surface of the insertion hole 3*a* of the insertion part 31 and the outer peripheral surface of the rebar 2.

As described above, the granular fine powder is an inorganic granule based fine powder such as silicon carbide based fine powder or an aluminum based fine powder with a grain size from 180 to 600 μm.

The diameter of the threaded portion 32 is previously reduced from the diameter of the insertion part 31 by plastic working, so as to be slightly smaller than the diameter of the insertion part 31.

An internal thread is formed in the threaded portion 32 so as to engage with the external thread formed on the outer peripheral surface of a connecting bolt 4.

The connecting bolt 4 is a column-shaped member with an external thread formed on the outer peripheral surface.

The diameter of the connecting bolt 4 corresponds to the diameter of the insertion hole 3*a* of the threaded portion 32 of the sleeve 3 so that the connecting bolt 4 can be screwed into the insertion hole 3*a* of the threaded portion 32 of the sleeve 3.

The axial length of the connecting bolt 4 is twice the length of the threaded portion 32 thereby allowing one end of the connecting bolt 4 to be screwed into the threaded portion 32 of one of the sleeves 3 as well as the other end of the connecting bolt 4 to be screwed into the threaded portion 32 of the other sleeve 3. In this manner, two sleeves 3, each of which with the rebar 2 inserted therein, can be connected together.

Figure 9:
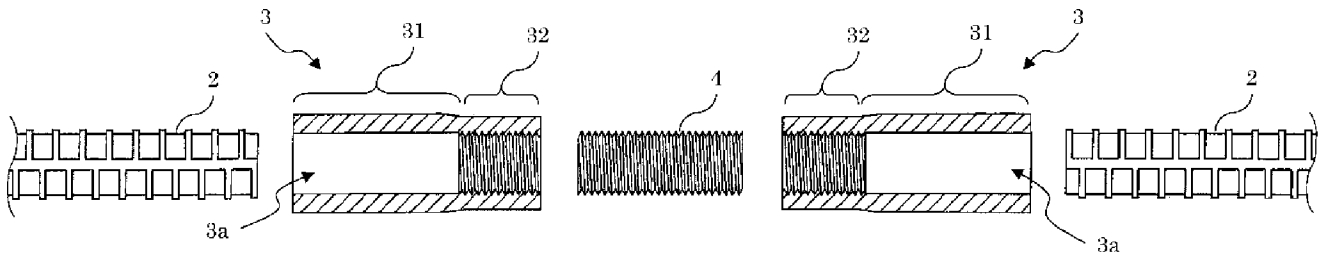
FIG. 9 is an exploded view illustrating components constituting another bonding structure of a rebar and a bonding attachment formed by the method of forming a bonding structure according to the embodiment.

Now, a method of forming a bonding structure to bond the rebar 2 and the sleeve 3 will be described referring to FIG. 9.

First, two sleeves 3 are prepared and the rebar 2 is inserted in the insertion hole 3*a* of the insertion part 31 of each of the sleeves 3. In this process, an application liquid mixed with a granular fine powder is previously applied to the inner peripheral surface of the insertion hole 3*a* of the sleeve 3 and the outer peripheral surface of the rebar 2 to adhere the granular fine powder on the inner peripheral surface of the insertion hole 3*a* of the sleeve 3 and the outer peripheral surface of the rebar 2.

Then, two sleeves 3, each of which having the rebar 2 inserted in the insertion hole 3*a* of the insertion part 31, are placed such that the openings at the end of the threaded portions 32 face each other, and one or the other end of the connecting bolt 4 is screwed into each of the threaded portions 32.

Further, the outer peripheral surface of the insertion part 31 having the rebar 2 inserted therein is pressed radially inward to carry out plastic working on the insertion part 31. By the pressing, the insertion part 31 shrinks to reduce the diameter and the inner peripheral surface of the insertion part 31 and the rebar 2 are bonded with the granular fine powder disposed in between.

In this manner, the rebar 2 is bonded to the inner peripheral surface of the insertion hole 3*a* of the insertion part 31 of each of two sleeves 3, and the sleeves 3 are connected by the connecting bolt 4, thereby connecting the two rebars 2.

As described above, similarly to the previous embodiment, the rebar 2 is bonded to the sleeve 3 with the granular fine powder disposed on the contact surfaces of the rebar 2 and the sleeve 3 in the embodiment. As a result, the granular fine powder increases the friction force between the rebar 2 and the sleeve 3 to enhance the bonding strength of the rebar 2 and the sleeve 3.

Note that, in the embodiment described above, the shape and the configuration of the mechanical joint are not particularly limited to those of the embodiment. Any shape and configuration allowing the rebar 2 to be inserted in the insertion holes 1*a* and 3*a* formed in the sleeves 1 and 3, can be applied.

Further, the granular fine powder can be disposed on the contact surfaces of the rebar 2 and the sleeves 1 and 3 by adhering the granular fine powder on one surface of a thin sheet of which other surface is adhered to the inner peripheral surface of the insertion holes 1*a* and 3*a*, or by melt adhesion in which the granular fine powder is sprayed on the inner peripheral surface of the insertion holes 1*a* and 3*a* of the heated sleeves 1 and 3.

In the method of forming a bonding structure of a rebar and a bonding attachment according to the embodiment, description is made for the case in which the mechanical joint for connecting rebars is formed. However, it is not limited to the embodiment. Another embodiment of the present invention may be configured as a method of forming a bonding structure of a rebar and a bonding attachment for fastening the rebar to concrete. An example of such embodiment is illustrated in FIGS. 10(A) to 10(E).

Figure 10:
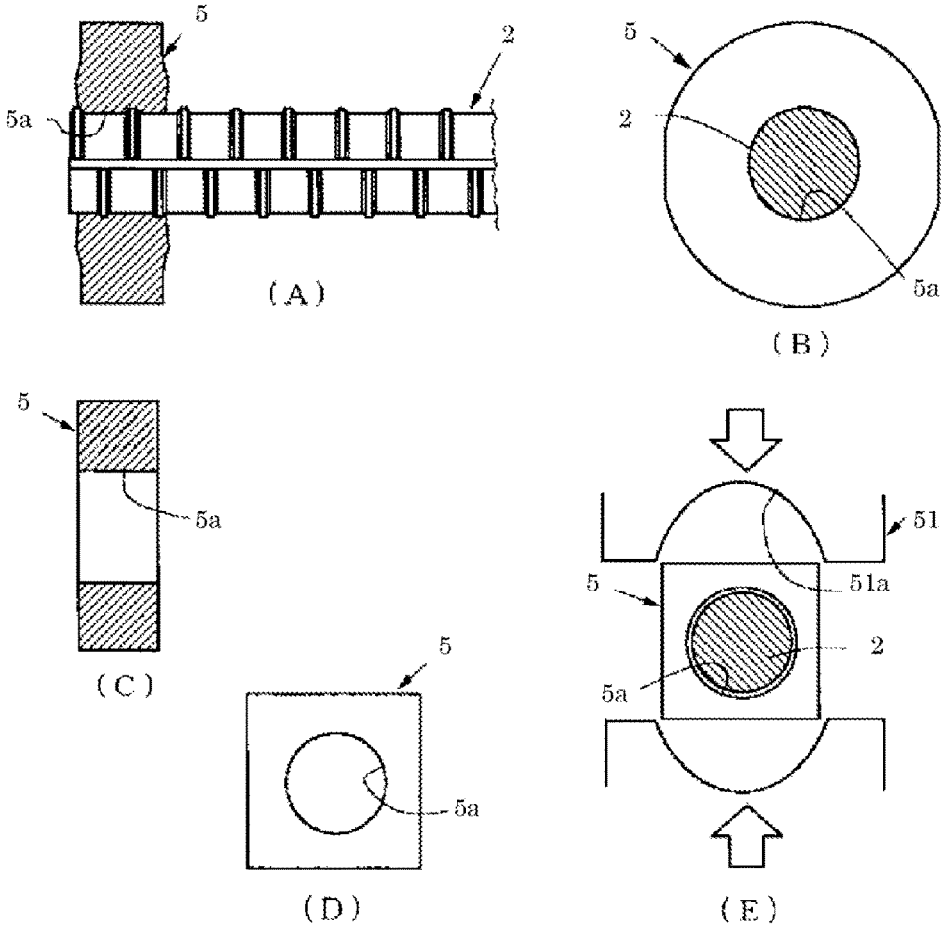
FIGS. 10(A) to 10(E) illustrate the method of forming a bonding structure according to the embodiment, and the bonding structure of a rebar and a bonding attachment formed by the method.

As illustrated in FIGS. 10(A) and 10(B), one end of a rebar 2 is inserted in an insertion hole 5*a*, having a circular cross section, formed in a bonding attachment 5 having an approximately elliptical cross section. The bonding attachment 5 is bonded to the rebar 2 with a granular fine powder disposed on the inner peripheral surface of the insertion hole 5*a* on which the bonding attachment 5 and the rebar 2 make contact.

A method of forming the bonding structure will be described referring to FIGS. 10(C) to 10(E).

First, the end portion of the rebar 2 is inserted in the insertion hole 5*a*, having a circular cross section, formed in the bonding attachment 5 having an approximately square cross section. Then, the bonding attachment 5 is pressed from the outer peripheral surface by a dice 51 having an arc shaped groove 51*a*. In this manner, the bonding attachment 5 is compressed and deforms to have a periphery having an approximately elliptic cross section, and in the same process, the bonding attachment 5 is bonded to the rebar 2.

In the embodiment, the bonding attachment 5 and the rebar 2 are also bonded with the granular fine powder disposed on the contact surfaces of the bonding attachment 5 and the rebar 2 by applying the application liquid mixed with the granular fine powder, before bonding, on the inner peripheral surface of the insertion hole 5*a* on which the bonding attachment 5 and the rebar 2 make contact.

Another bonding structure formed by the method of forming a bonding structure according to the embodiment is illustrated in FIGS. 11(A) to 11(E).

Figure 11:
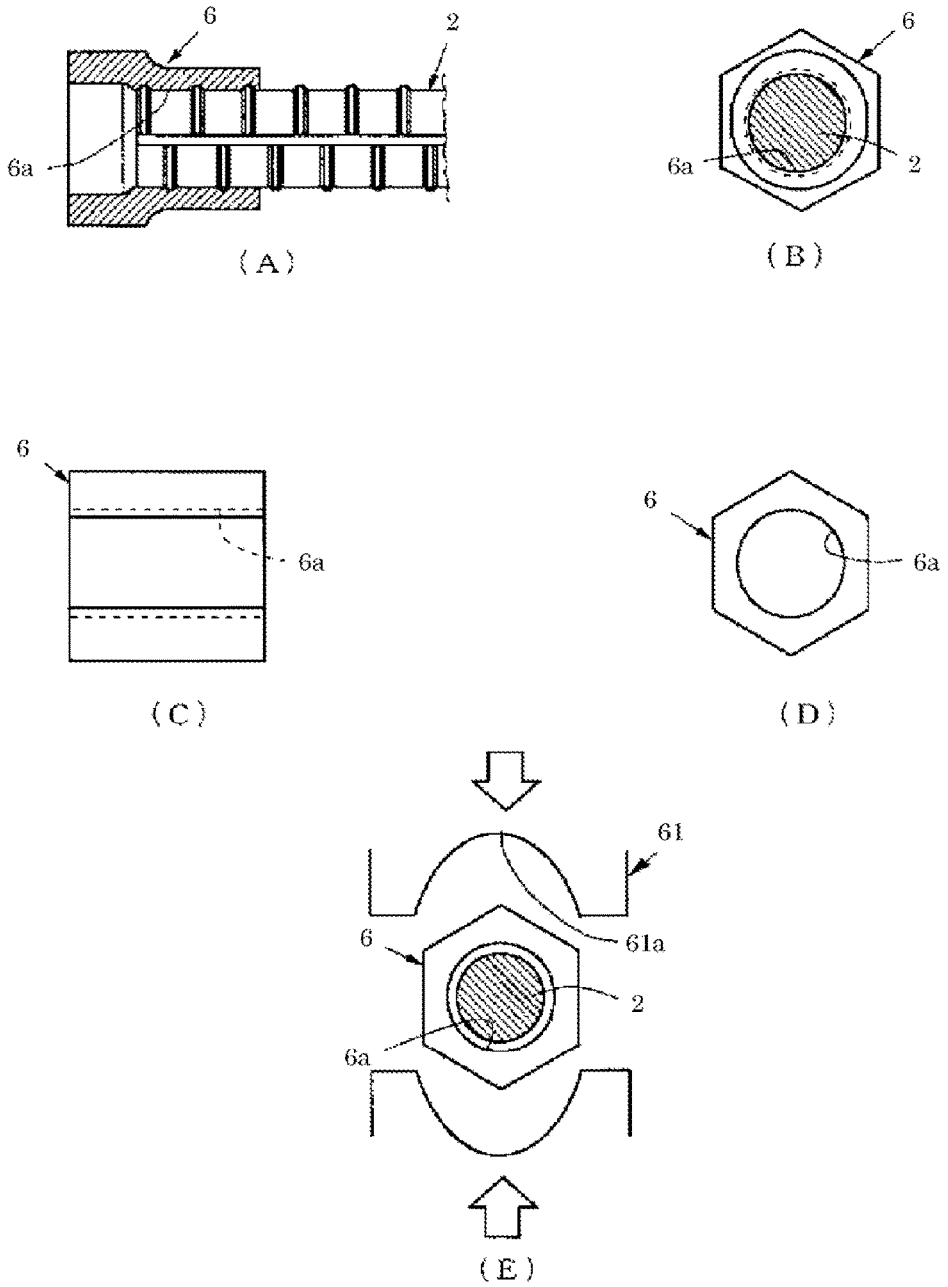
FIGS. 11(A) to 11(E) illustrate the method of forming a bonding structure according to the embodiment, and the bonding structure of a rebar and a bonding attachment formed by the method.

As illustrated in FIGS. 11(A) and 11(B), a bonding attachment 6 including an insertion hole 6*a* having a circular cross section includes a portion with an outer periphery having a hexagonal cross section and a portion with an outer periphery having a circular cross section produced by compressing and deforming the hexagonal cross section. One of both end portions of the rebar 2 is inserted in the insertion hole 6*a* in the portion having a circular cross section produced by compressing and deforming. In the portion of the insertion hole 6*a* where the rebar 2 is inserted, the bonding attachment 6 and the rebar 2 is bonded with the granular fine powder disposed in between.

A method of forming the bonding structure will be described referring to FIGS. 11(C) to 11(E).

First, the end portion of the rebar 2 is inserted in the insertion hole 6*a* to half the length of the insertion hole 6*a* having a circular cross section formed in the bonding attachment 6 having a hexagonal cross section. Then, the portion of the bonding attachment 6 in which the rebar 2 is inserted is pressed from the outer peripheral surface by a dice 61 having an arc shaped groove 61*a*. In this manner, the pressed portion of the bonding attachment 6 is compressed and deforms to have an approximately circular cross section, and the bonding attachment 6 is bonded to the rebar 2 in the deformed portion. A step is formed on the outer periphery surface by the process of producing the bonding. Thereby, the bonding attachment 6 is now configured with the portion having an original hexagonal cross section and the compressed portion having a circular cross section.

In the embodiment, the bonding attachment 6 and the rebar 2 are also bonded with the granular fine powder disposed on the portion contacting each other by applying the application liquid mixed with the granular fine powder, before bonding, on the bonding attachment 6 or the rebar 2. Further, the bonding attachment 6 can enhance the fixing force on concrete by the step on the outer periphery surface formed in the process of producing the bonding.

Another bonding structure formed by the method of forming a bonding structure according to the embodiment is illustrated in FIGS. 12(A) to 12(G).

Figure 12:
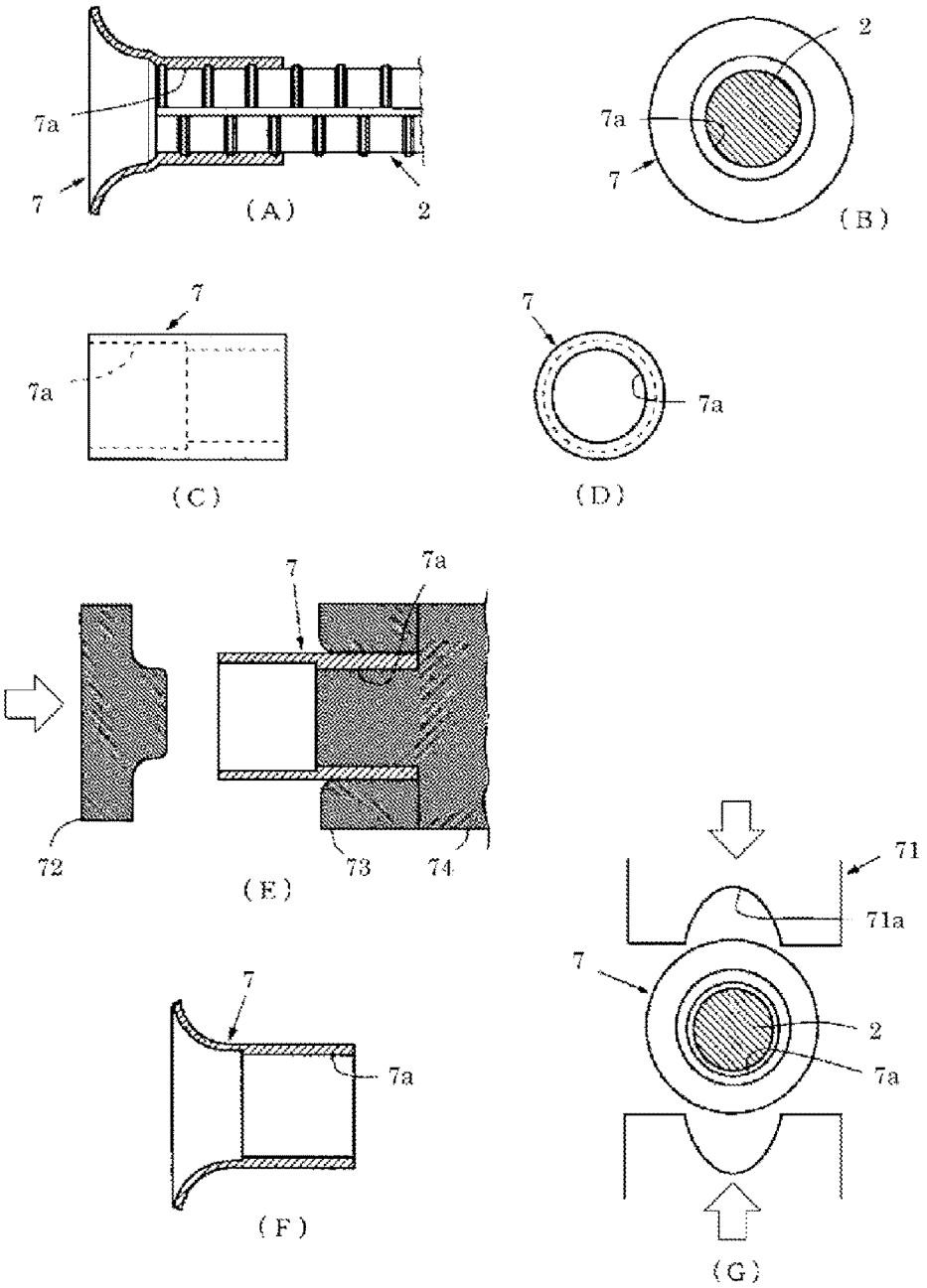
FIGS. 12(A) to 12(G) illustrate the method of forming a bonding structure according to the embodiment, and the bonding structure of a rebar and a bonding attachment formed by the method.

As illustrated in FIGS. 12(A) and 12(B), a bonding attachment 7 including an insertion hole 7*a* having a circular cross section includes a thin sleeve-shaped portion having a circular cross section and a thick portion of which diameter gradually increases from the end of the sleeve-shaped portion. One of ends of the rebar 2 is inserted in the insertion hole 7*a* of the sleeve-shaped portion. In the portion of the insertion hole 7*a* where the rebar 2 is inserted, the bonding attachment 7 is bonded to the rebar 2 with the granular fine powder disposed in between.

A method of forming the bonding structure will be described referring to FIGS. 12(C) to 12(G).

First, chucks 73 and 74 are attached to the sleeve-shaped bonding attachment 7 with an insertion hole 7*a* having a circular cross section formed therein. Then, a dice 72 having a column-shaped protrusion which can be inserted in the inner circumference of the thin portion is pressed on to the end portion of the thin portion. Thus, the end portion of the thin portion is stretched to increase the diameter, and then pressed by the flat portion of the dice 72 to expand. Thereby, the thin portion expands toward the end. Then, the rebar 2 is inserted in the insertion hole 7*a* in the thick portion which is not expanded. The portion of the bonding attachment 7 in which the rebar 2 is inserted is pressed from the outer peripheral surface by a dice 71 having an arc shaped groove 71*a*. In this manner, the pressed portion of the bonding attachment 7 is compressed and deforms, and the bonding attachment 7 is bonded to the rebar 2.

In the embodiment, the bonding attachment 7 and the rebar 2 are also bonded with the granular fine powder disposed on the portion contacting each other by applying the application liquid mixed with the granular fine powder, before bonding, on the bonding attachment 7 or the rebar 2. Further, the bonding attachment 7 can enhance the fixing force on concrete by the portion expanding toward the end.

Another bonding structure formed by the method of forming a bonding structure according to the embodiment is illustrated in FIGS. 13(A) to 13(G).

Figure 13:
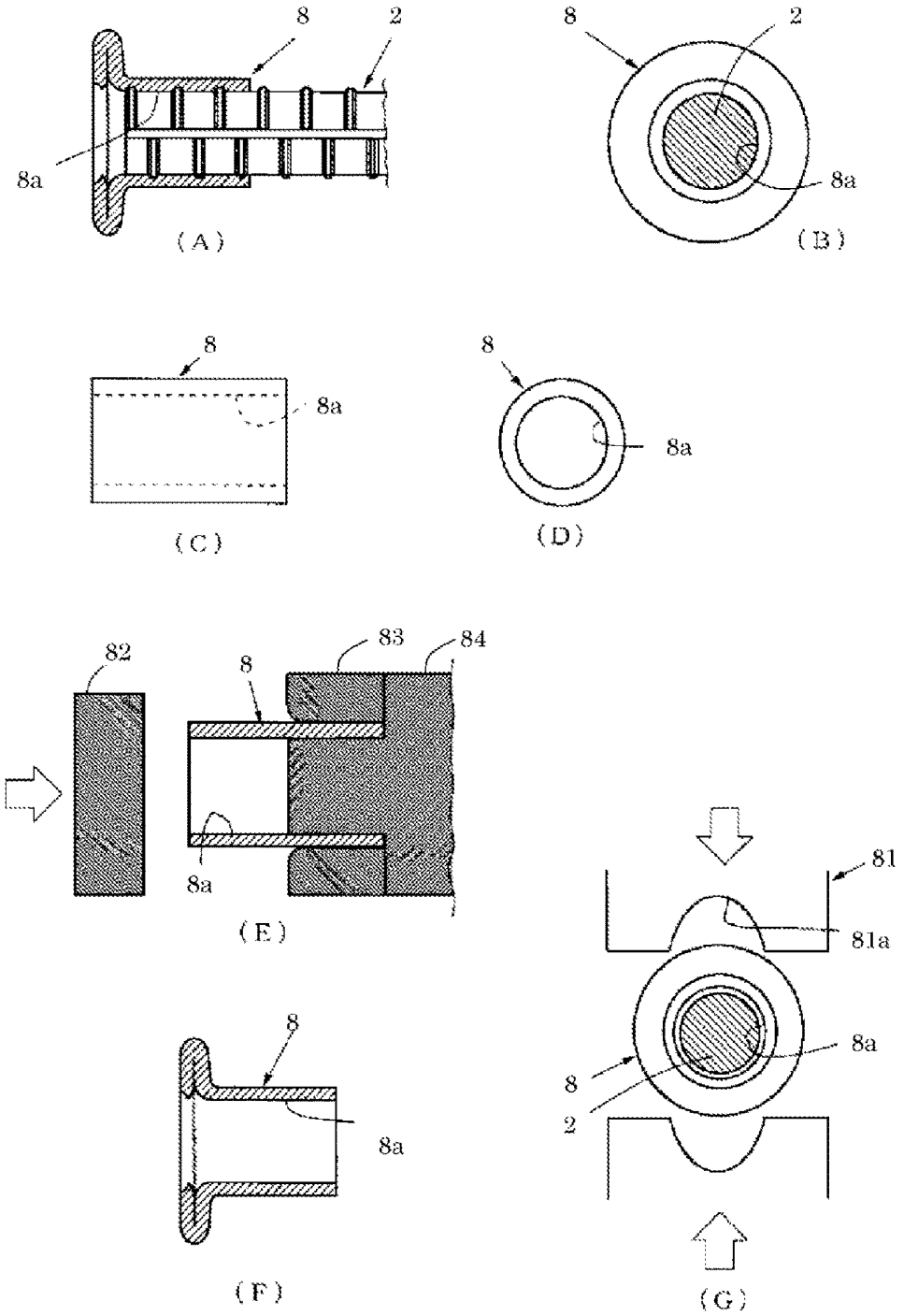
FIGS. 13(A) to 13(G) illustrate the method of forming a bonding structure according to the embodiment, and the bonding structure of a rebar and a bonding attachment formed by the method.

As illustrated in FIGS. 13(A) and 13(B), a bonding attachment 8 including an insertion hole 8*a* having a circular cross section includes a sleeve-shaped portion having a circular cross section and a portion which expands from the end portion of the sleeve-shaped portion and then is folded inward. One of ends of the rebar 2 is inserted in the insertion hole 8*a* of the sleeve-shaped portion. At the portion of the insertion hole 8*a* in which the rebar 2 is inserted, the bonding attachment 8 is bonded to the rebar 2 with the granular fine powder disposed in between.

A method of forming the bonding structure will be described referring to FIGS. 13(C) to 13(G).

First, chucks 83 and 84 are attached to the sleeve-shaped bonding attachment 8 with an insertion hole 8*a* having a circular cross section formed therein. The dice 82 is subsequently pressed on to the end surface of the bonding attachment 8. Thereby, the end surface buckles to expand outward. By further pressing the dice 82, the end surface is folded in a two-fold shape. The rebar 2 is inserted in the insertion hole 88 in the sleeve-shaped portion. The portion of the bonding attachment 8 in which the rebar 2 is inserted is pressed from the outer peripheral surface by a dice 81 having an arc shaped groove 81*a*. In this manner, the pressed portion of the bonding attachment 8 is compressed and deforms, and the bonding attachment 8 is bonded to the rebar 2.

In the embodiment, the bonding attachment 8 and the rebar 2 are also bonded with the granular fine powder disposed on the portion contacting each other by applying the application liquid mixed with the granular fine powder, before bonding, on the bonding attachment 8 or the rebar 2. Further, the bonding attachment 8 can enhance the fixing force on concrete by the portion expanding toward the end.

Further, a bonding structure according to another embodiment formed by the method of forming a bonding structure according to the embodiment is illustrated in FIGS. 14(A) to 14(F).

Figure 14:
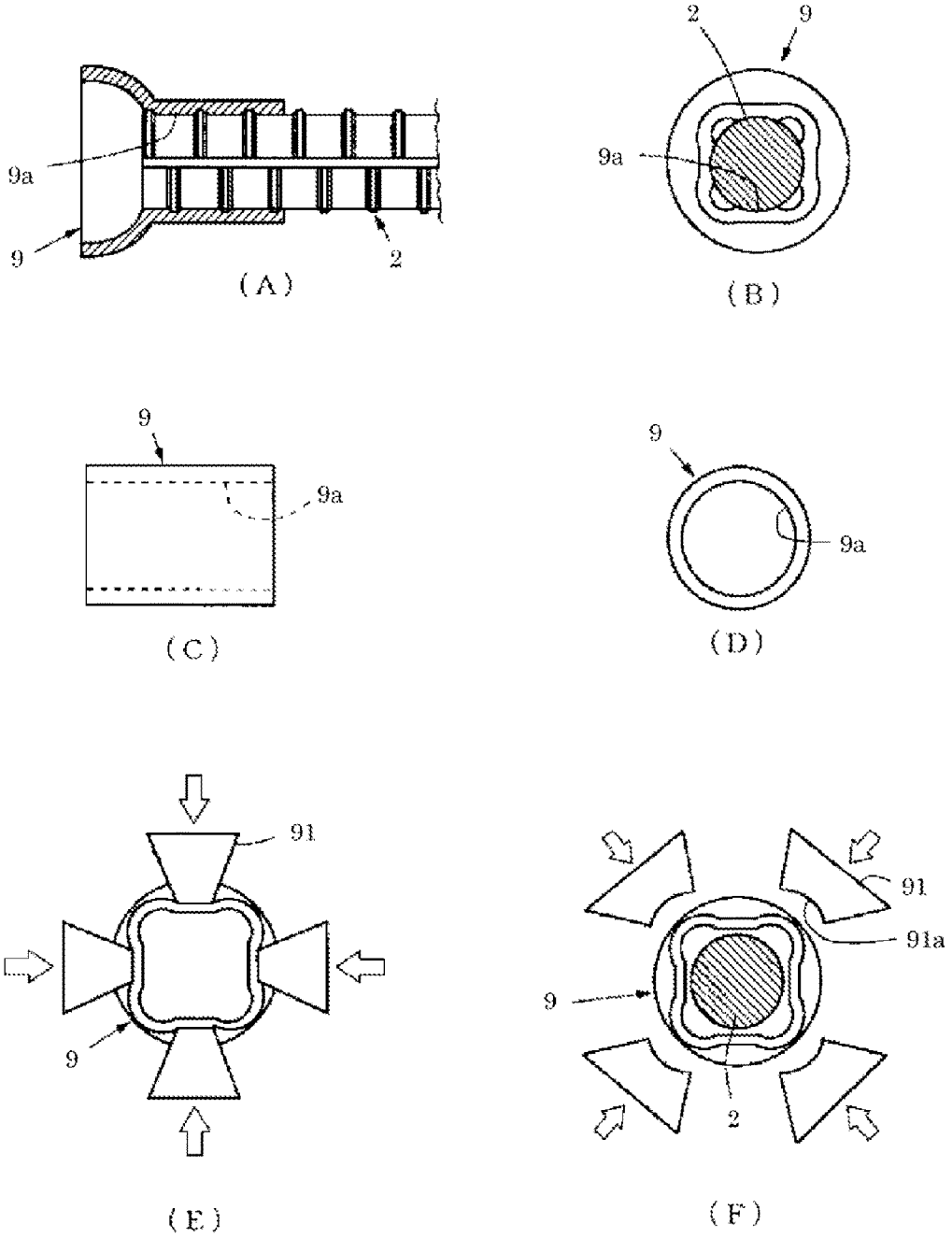
FIGS. 14(A) to 14(F) illustrate the method of forming a bonding structure according to the embodiment, and the bonding structure of a rebar and a bonding attachment formed by the method.

As illustrated in FIGS. 14(A) and 14(B), a bonding attachment 9 including an insertion hole 9*a* including a sleeve-shaped portion in which the insertion hole 9*a* having an approximately rectangular cross section with round corners is formed and a portion, in which the insertion hole 9*a* having a circular cross section is formed, expanding toward the end from the end portion of the sleeve-shaped portion. One end of the rebar 2 is inserted in the sleeve-shaped portion. At the portion of the sleeve-shaped portion in which the rebar 2 is inserted, the bonding attachment 9 is bonded to the rebar 2 with the granular fine powder disposed in between.

A method of forming the bonding structure will be described referring to FIGS. 14(C) to 14(G).

First, the periphery of the sleeve-shaped portion is pressed from four directions by four trapezoidal dices 91 to form the insertion hole 9*a* having an approximately rectangular cross section with round corners. Then, the located end portion of the rebar 2 is inserted in the sleeve-shaped portion. The round corner of the insertion hole of the portion of the bonding attachment 9 in which the rebar 2 is inserted is pressed toward the center by the four dices 91 having an arc shaped grooves 91*a*. In this manner, the pressed portion of the bonding attachment 9 is compressed and deforms, and the bonding attachment 9 is bonded to the rebar 2.

In the embodiment, the bonding attachment 9 and the rebar 2 are also bonded with the granular fine powder disposed on the portion contacting each other by applying the application liquid mixed with the granular fine powder, before bonding, on the bonding attachment 9 or the rebar 2. Further, the bonding attachment 9 can enhance the fixing force on concrete by the portion expanding toward the end.

The entire disclosure of the specification, the drawings, and the abstract included in Japanese Patent Application No. 2003-362703 filed Oct. 23, 2003 is hereby incorporated by reference.

REFERENCE SIGNS LIST

1 sleeve
1*a* insertion hole
2 rebar
3 sleeve
3*a* insertion hole
31 insertion part
32 threaded portion
4 connecting bolt
5 to 9 bonding attachment
10 granular fine powder

The invention claimed is:

1. A method of forming a bonding structure to bond a bonding attachment to a rebar, the bonding attachment having an insertion hole for inserting the rebar therein, the method comprising:

applying an application liquid including a water-soluble resin emulsion, which is mixed beforehand with a granular fine powder with a grain size of 180 to 600 μm, on an outer peripheral surface of the rebar and/or an inner peripheral surface of the insertion hole of the bonding attachment;

inserting the rebar in the insertion hole of the bonding attachment; and bonding the bonding attachment to the rebar by pressing the bonding attachment with the rebar inserted in the insertion hole, wherein the granular fine powder is silicon carbide based material or aluminum based material.

2. The method of forming a bonding structure according to claim 1, wherein the grain size of the granular fine powder is from 180 to 300 μm.

* * * * *